US008211843B1

(12) United States Patent
Offenhartz

(10) Patent No.: US 8,211,843 B1
(45) Date of Patent: Jul. 3, 2012

(54) WATER BASED COMPOSITION DEVELOPED TO CLEAN INK-JET CARTRIDGE NOZZLE HEADS, BY UNCLOGGING SAID NOZZLE HEAD(S) OF PAPER FLASH, INK-RESIDUE, AND ALL OTHER DEBRIS, WHICH RESULTS IN THE INCREASE OF INK YIELD, MAINTAINED PRINT QUALITY, AND THE EXTENSION OF THE USEFUL LIFE OF SAID INK-JET CARTRIDGE

(76) Inventor: David Offenhartz, Canton, CT (US)

( * ) Notice: Subject to any disclaimer, the term of this patent is extended or adjusted under 35 U.S.C. 154(b) by 20 days.

(21) Appl. No.: 12/807,824

(22) Filed: Sep. 14, 2010

Related U.S. Application Data

(63) Continuation of application No. 12/802,356, filed on Jun. 4, 2010, now abandoned.

(60) Provisional application No. 61/185,023, filed on Jun. 8, 2009, provisional application No. 61/232,444, filed on Aug. 9, 2009, provisional application No. 61/263,362, filed on Nov. 21, 2009.

(51) Int. Cl.
*B41J 2/165* (2006.01)

(52) U.S. Cl. ..... 510/170; 347/28

(58) Field of Classification Search ..... 510/170; 347/28
See application file for complete search history.

(56) References Cited

U.S. PATENT DOCUMENTS

| | | | | |
|---|---|---|---|---|
| 6,158,838 | A * | 12/2000 | Capurso | 347/28 |
| 6,601,943 | B2 * | 8/2003 | Barinaga | 347/33 |
| 2005/0062797 | A1 * | 3/2005 | Kachi | 347/33 |
| 2006/0139395 | A1 * | 6/2006 | Nakashima et al. | 347/22 |
| 2007/0247484 | A1 * | 10/2007 | Sanada et al. | 347/23 |
| 2008/0283092 | A1 * | 11/2008 | Nagai et al. | 134/6 |

* cited by examiner

*Primary Examiner* — Mark Eashoo
*Assistant Examiner* — M. Reza Asdjodi

(57) ABSTRACT

An end user implemented preventative maintenance process, made to clean ink-jet cartridges. The methodology consists of an organic solution injected into a lint free wipe, which, when applied to the print head nozzle surface of an ink-jet cartridge, leaches dried ink, paper lint, dirt, and other contaminants. The use of a lint free dry wipe, to blot any remaining ink from the print head nozzles after cleaning, provides streak-less printing, and assures the end user that preventative maintenance has been accomplished. Using this process noticeably extends the useful life of ink-jet print cartridges, while maintaining the integrity of print quality.

4 Claims, No Drawings

WATER BASED COMPOSITION DEVELOPED TO CLEAN INK-JET CARTRIDGE NOZZLE HEADS, BY UNCLOGGING SAID NOZZLE HEAD(S) OF PAPER FLASH, INK-RESIDUE, AND ALL OTHER DEBRIS, WHICH RESULTS IN THE INCREASE OF INK YIELD, MAINTAINED PRINT QUALITY, AND THE EXTENSION OF THE USEFUL LIFE OF SAID INK-JET CARTRIDGE

This Non-Provisional Patent Application is a Continuation of Non-Provisional application Ser. No. 12/802,356 filed Jun. 4, 2010 now abandoned

CROSS REFERENCES

| U.S.P.T.O. Non-Provisional Application on file: | | | |
|---|---|---|---|
| Application #12/802,356 | | Jun. 4, 2010 | |
| U.S.P.T.O. Provisional Applications on file: | | | |
| Application #61185023 | | Jun. 8, 2009 | |
| Application #61232444 | | Aug. 9, 2009 | |
| Application #61263362 | | Nov. 21, 2009 | |
| Independent Ink-Cartridge Industry Reports: | | | |
| "How much ink is left in that Dead Cartridge?" | Jeff Bertolucci | PC WORLD | Nov. 2, 2008 |
| "The hidden costs of Home Printing." | Zoe Kleinman and Mark Ward | BBC NEWS | Sep. 1, 2009 |

BACKGROUND OR PRIOR ART

In July of 2007, I formed an LLC, Reality Check, which was the nation's first provider of Same Day, Guaranteed Four Hour Response Time, for the repair or replacement of any Check 21, Remote Deposit Capture, or Branch Scanning Device. As part of routine Preventative Maintenance, I purchased supplies in order to clean said devices, and noticed a recurring problem: Ink Endorsement Legibility was barely, if at all legible, and cartridges had a noticeable build up on the external surface area of the Ink-Jet nozzle head. Not only was the problem impacting the process of Check 21 Technology (an unendorsed check could be re-deposited in the same, or a different, Financial Institution), it was also not reliably, nor easily fixable with the cleaning products currently on the market. Many of these products, aside from being skin, eye, and respiratory irritants, are typically flammable due to their composition of 99% Isopropyl Alcohol, along with other cleaning agents derived from a mixture of silicone and Isopropyl Alcohol. Each of the aforementioned products have a destructive effect on belts and other rubber components, as repetitive use causes "brittleness" and leads to the decomposition of said rubber based parts found in devices which utilize Ink-Jet technology. When alcohol products were used, the Cartridge printed very well for 15-20 checks; after this, it was back to faint to no legible endorsements. The silicone based products fared worse; I used them to clean 15 ink-jets, and within several minutes the cartridges were completely "empty".

It became very clear from day one that Ink endorsement issues were the chief scanner complaint. According to Manufacturers Specifications, the standard cartridge used in most (if not all) scanner systems has a reported Yield of 7.2 Million characters. If the Endorsement Line is 24 or 32 characters (the standard), using 28 characters as "the average", it is easily extrapolated that an Ink-Jet cartridge should endorse 257,143 items. A "scanned item count" equal to 5% of aforementioned yield (a total endorsed item count of 12,858) is more congruous with "Real World" results and, the "end of the useful life of the ink-jet cartridge", having been realized, initiates cartridge replacement, thereby perpetuating the costly and non-productive downward cycle.

This glaring and repetitive "Issue" initiated my quest to "solve the ink-jet problem", which I realized was a problem that hit close to home: My cost for ink to print black and white documents was a large "chunk" of my fixed operating expense; this really seemed strange, as I didn't feel as though I'd printed "thousands", let alone "hundreds" of pages. I began to ask questions; family, friends, and Colleagues: The consensus was unanimous: The Fluid Composition had a multitude of applications, including, but not limited to, the cleaning of Ink-Jet Print Nozzles, and the resulting increase of Ink Yield, both black and color, as well as Postage meter "ink pads" and/or other descriptive names which portray ink-jet technology as presented herein.

It was necessary for me to find "Non-Biased Industry Reports" to validate the "shocking" information that I had stumbled upon. Said reports are referenced above, and I would like to quote a poignant point from each of the articles, to drive home the fact that "THE INK-JET ISSUE" has been "revealed", and Negatively impacts both Individuals and Corporations who rely on Ink-Jet printing technology:

"PC World Test Center results show models from Canon, Epson, and Kodak reported ink cartridges as being empty when in some cases the tanks had 40% of their black ink remaining."

(Jeff Bertolucci, PC World). Nov. 2, 2008

"A study by Epson carried out in 2007 found that up to 60% of ink in a cartridge goes to waste."

From the BBC Article referenced: (Zoe Kleinman and Mark Ward); Sep. 1, 2009.

(The tests were conducted by the TUV Rheinland Research Group on behalf of Epson. I have included the above quote to point out that the "PROBLEM" has been addressed repeatedly, and for years).

For at least 3 years, the General Public has been notified of the negative implications associated with the "WASTE" of un-used Ink-Jet Ink that is often discarded as soon as the "device" sends a message indicating "low ink; change now". It has been long enough, and there is now "In Commerce" a user friendly Fluid Composition, in the "best delivery system" as of this Non-Provisional Patent Application, which provides a proven remedy that both Cleans ink-jet cartridge print nozzles and print heads, as well as extends the "useful life" of said cartridges by enabling "free flowing ink" which increases the "Print per Cartridge" Yield by up to as much as 40% or more.

BRIEF SUMMARY OF INVENTION

Create a Fluid Composition that is:

a) Effective, in that said product will clean Ink-Jet nozzles and Print Heads of debris, while simultaneously increasing print yield per cartridge, while maintaining Print Quality.

b) User Friendly, First to Market (thereby unique), and "Eco-Friendly".

I began to tinker with water based products, and found several that worked—if used within a limited time-frame. The key component to the Fluid Composition was Red Cider Vinegar, which contains more than 100 compounds and is very hard to replicate. The key problem: the "naturally occurring phenomenon of the Mother Acidobacteria". Due to the ever-present sugar supply inherent to Red Cider Vinegar, the Mother would appear within several weeks, first as tadpoles, and then as "jelly-fish". It was a successful failure, and led to the creation of a working "Fluid Composition" for which this entire Non Provisional Patent Application is based. The Product, currently in commerce, has proven to be a winner, and users have experienced results which support the claims of this Non Provisional Patent Application, while exceeding cost-savings estimates as a result of using said Fluid Composition. Use of said Fluid Composition reduces the frequency of Ink-Jet Cartridge purchases, substantiating the claim that ink Yield per cartridge is greater. At the same time, use of said Fluid Composition assures legible print quality consistent with that of a "brand new cartridge". The renewed legibility further supports the claims discussed above, and re-stated at the end of the DETAILED DESCRIPTION OF THE INVENTION, on a separate page entitled "CLAIMS".

DETAILED DESCRIPTION OF EMBODIMENT

The Fluid Composition Recipe Range 91.935%-99.995% De-Ionized, or Distilled, water.
0.035%-0.065% Distilled White Vinegar.
0.005% Kathon.

Testing of the Fluid Composition within the ranges above, resulted in an effective remedy for the Ink-Jet "Issues" outlined herein. Following below is the Embodiment of the FLUID COMPOSITION RECIPE that is currently being used in Commerce. When used in a Wet/Dry Wipe format, is representative of the Inventor's best mode contemplated for carrying out the Embodiment as of the time of this Non Provisional Patent Filing. Many other viable "application techniques" have been tested, including, but not limited to: Pump-Spray Bottle application to a "wipe"; Eye-Dropper applicator used with fine grade medical gauze; as well as a "sponge-tip" applicator. Again, while each achieved desirable results, the best mode contemplated by me involves two sets of 7"×5" Wipes, composed of wood-pulp and nylon. One set is injected with the Fluid Composition Recipe, and is labeled "Wet". The other set is Not Injected, and labeled "Dry". As currently packaged, each Bag uses a re-sealable label, and the bags are glued back to back, so that both Wet and Dry Wipes are readily available. The Wet wipes leach "corks" of debris from upwards of 90 microscopic ink-jets, and establish "free-flowing ink". The Dry wipes are used for blotting excess free-flow ink, resulting in immediately noticeable Print Quality improvement.

Fluid Composition Recipe Currently in Commerce 99.945% Distilled or De-Ionized Water.
0.05% Distilled White Vinegar.
0.005% Kathon. (A preservative that prevents mold from appearing on Wet wipe).
2.1 grams of solution is currently injected into Wet Wipes, composed of wood pulp and nylon fibers. Each wipe measures 7"×5".

What is claimed:

1. An organic solution consisting of 99.945% distilled or de-ionized water, 0.05% distilled white vinegar, and 0.005% KATHON, a preservative eliminating mold growth on the wipe, by injecting 2.10 grams of the organic solution, creating a wet wipe and eliminating mold growth on the wipe, and the ink-jet cartridge print head nozzle area, after contacting nozzle area with wet wipe.

2. A process of preventative maintenance for the cleaning of ink-jet cartridge print nozzle heads, injecting an organic solution according to composition of claim 1 into lint free wipe, and manually applying to the print head nozzles, contacting wet wipe to print head nozzles leaching contaminants, paper flash, ink residue, and other debris, resulting in unclogging the print head nozzles, and extending the useful life of the ink-jet cartridge.

3. A preventative maintenance process for cleaning ink-jet cartridge print head nozzles using the organic solution according to claim 1, comprising:

a. Removing a wet wipe from the peel/reseal package labeled wet;
b. Removing a dry wipe from the peel/reseal package labeled dry;
c. Removing ink-jet cartridge from device, and holding between thumb and forefinger with print head nozzles facing away from your body;
d. With free hand, holding wet wipe and contacting print head nozzles for 3-4 seconds;
e. Inspecting print head nozzles and wet wipes; if the wipe is containing ink, and there is accumulating of ink on print head nozzles, proceeding to step f below; if there is no noticing of ink-blot on wipe, or any accumulating ink on print head nozzles, repeating step e until the wipe is containing ink, and there is accumulating ink on the print head nozzle;
f. While holding cartridge, picking up dry wipe and applying light pressure to print head nozzle area, keeping dry wipe contacting the print nozzles for 3 to 4 seconds;
g. Inspecting print nozzle head and dry wipe, if noticing a blot of ink on the dry wipe, and the surface area of the print nozzle head is free of accumulating ink, completing preventative maintenance is accomplished;
h. Placing ink-jet cartridge back into device and beginning or resuming printing.

4. An organic solution consisting of distilled or de-ionized water, distilled white vinegar, and KATHON, a preservative eliminating mold growth on the wipe, by injecting the organic solution, creating a wet wipe and eliminating mold growth on the wipe, and the ink-jet cartridge print head nozzle area, after contacting nozzle area with wet wipe.

* * * * *